US005791077A

United States Patent [19]

Felber

[11] Patent Number: 5,791,077

[45] Date of Patent: Aug. 11, 1998

[54] ADVERTISING SUPPORT FOR FITTING ON A VEHICLE

[75] Inventor: Josef Felber, Zurich, Switzerland

[73] Assignee: Technikus AG, Furstentum, Liechtenstein

[21] Appl. No.: 809,157

[22] Filed: Mar. 4, 1997

[30] Foreign Application Priority Data

Sep. 2, 1994 [CH] Switzerland ..... 02 686/94-6

[51] Int. Cl.[6] ..... G09F 15/00

[52] U.S. Cl. ..... 40/610; 40/592; 446/220

[58] Field of Search ..... 40/212, 588, 590, 40/592, 601, 610; 446/220, 226

[56] References Cited

U.S. PATENT DOCUMENTS 862,904 8/1907 Harrison ..... 40/590
5,024,012 6/1991 Lovik ..... 40/212

FOREIGN PATENT DOCUMENTS 2290327 6/1976 France ..... 40/592

*Primary Examiner*—Cassandra H. Davis
*Attorney, Agent, or Firm*—Edwin D. Schindler

[57] ABSTRACT

The advertising support consists of a stowage space (3) with an opening top and an inflatable advertising support (11) stowed inside it which, when the top of the stowage space (3) is opened, can be inflated upwards from it. In the stowage space (3) there is a scissors structure (7,17) which can be erected by a motor and forms a stable-sided parallelogram which is free-standing and, in the expanded position, extends along the internal height of the inflated advertising support (11). It ensures that, when the scissors structure (7,17) is retracted and the advertising support (11) is deflated at the same time, said advertising support (11) is substantially folded down onto its original base area and prevented from tipping sideways by the lateral stability of the scissors structure.

2 Claims, 4 Drawing Sheets

ADVERTISING SUPPORT FOR FITTING ON A VEHICLE

This invention relates to an advertising support for fitting on a vehicle. Prior art inflatable advertising supports already exist. They are usually made from textile-reinforced plastic film, namely from the same material from which e.g. lorry sheeting is manufactured. These advertising supports are designed in exactly the same shape as the product they are advertising, and they are printed and labelled in exactly the same way as the original product. Hence they are visual scale enlargements of the original product. Advertising supports of this type are erected outdoors or in buildings and their shape is retained by the air blown into them, like an inflatable building. A beer can that is e.g. six meters high can be inflated in just a few minutes with a fan of approx. 150 watts, and, once inflated, an adult can easily stand inside the can. The lower edge of the can, which is open at the bottom, does not even need to be sealed in any special way, but can rest loosely against the ground.

The attraction of inflatable advertising supports is that the actual product being advertised can be shown on a very enlarged scale. This creates advantages because, on the one hand, the product sticks 1:1 in the viewer's memory. On the other hand, an inflatable advertisement attracts great interest amongst the public because of its outsize dimensions, which are easy to achieve. However, perhaps the greatest attention is attracted at the actual moment of inflation because something very interesting for the viewers is in motion during that time. Conventional inflatable advertisements are however conceived as stationary publicity once they are inflated.

In contrast, this invention is based on the task of exploiting the advantages of inflatable advertising supports in a mobile manner, i.e. of enabling them to be quickly and consecutively erected in different locations. Furthermore, the inflation, deflation and retraction of the advertising support, i.e. the motion associated with these procedures, are to be able to be used to attract attention. The invention will also make it possible to erect an inflatable advertising support in locations where this would not be feasible with a stationary advertising support, and, finally, it will also allow an inflatable advertising support to be automatically erected in consecutive locations, i.e. inflated rapidly and then retracted again by one person actuating a button, and then moved on to the next location.

This task is solved with an advertising support for fitting on a vehicle which is characterized by a stowage space with an opening top and an inflatable advertising support stowed inside it which, when the top of the storage space is opened, can automatically be inflated upwards from it and then folded down again.

Examples of embodiments of such an advertising support will be described with reference to the drawings, and the function of these advertising supports will be explained in detail.

Figure 1:
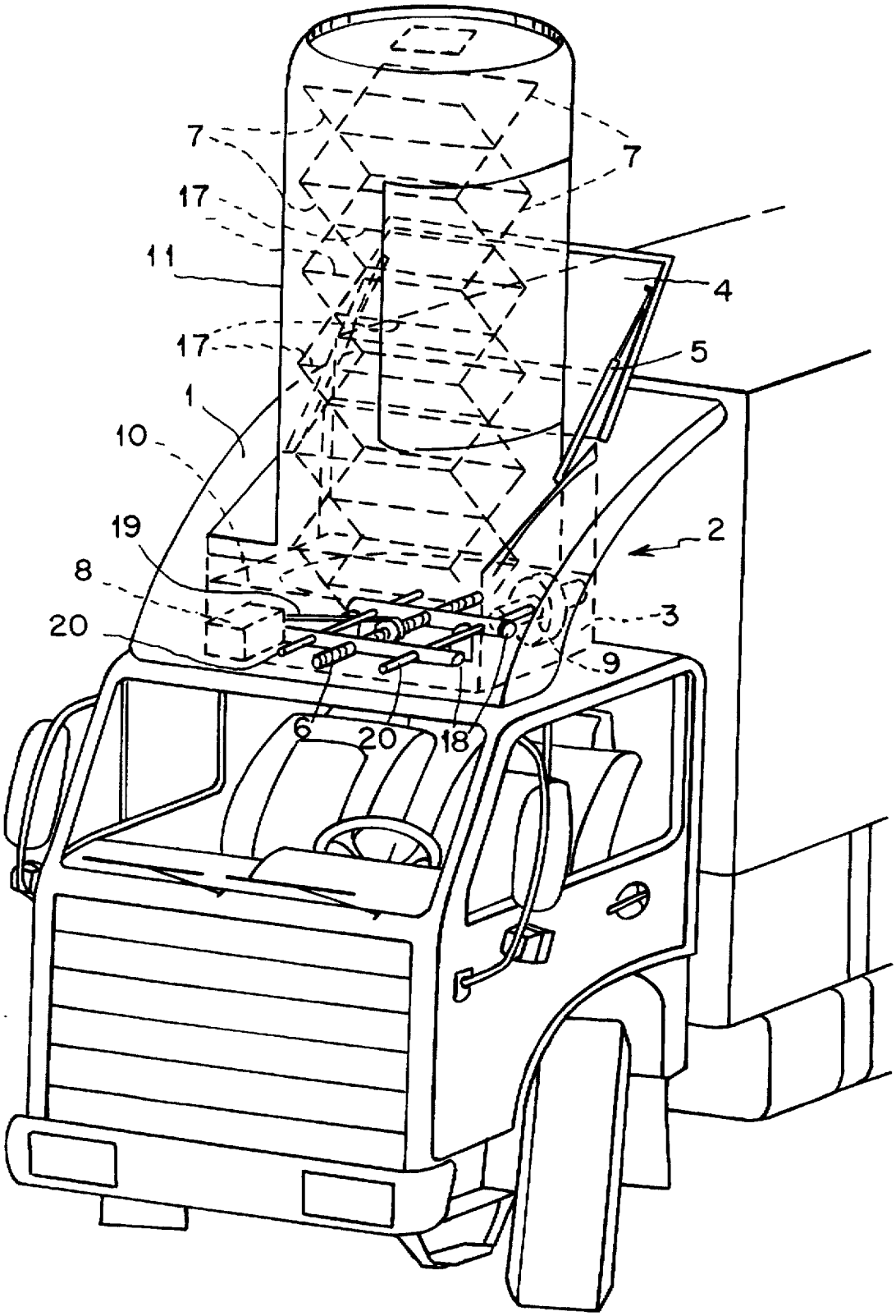
FIG. 1 shows an advertising support with inflated support, built onto the roof of a lorry.

FIG. 1 shows a perspective view of the front part of a lorry. A spoiler 1 is fitted on the cabin roof of this lorry. The advertising support 2 is built onto the cabin roof underneath this spoiler 1. It consists of a stowage space 3 which forms a box which can be made from sheet aluminium or plastic, for example. In this Figure the box stands on the roof of the cabin and its underside is fitted with vertically adjustable feet for this purpose. These may be, for example, four small rubber claws on the bottom edges of the box, which can more or less be screwed into the underside of the box with threaded screws. This makes it possible to adapt the box to any lorry roof. The box is sloped at the top along approximately the same angle as the spoiler 1.

In this Figure, this box or storage space 3 has a flap 4 which can be swung open and shut on hinges on the top rear side of the storage space. Here, the storage space 3 or the box 3, which constitutes the former, projects slightly out of a corresponding opening cut in the spoiler 1. In one variant, however, the storage space 3 can also be designed so that the top of its side walls end flush with the underside of the spoiler 1, with the flap 4 then being an integral element of the spoiler 1. Whatever the case, the flap 4 is designed so that when closed, it prevents rainwater from penetrating into the storage space 3. In the example shown here, the flap 4 is supported by gas-operated supports 5, which swing the flap 4 up out of its closed position. There is also a small pull cord (not shown here) for closing the flap 4 against the force of the gas-operated supports 5 by means of a 12 or 24 volt electrical winch (depending on the type of vehicle). In an alternative embodiment, the flap 4 can also be opened and closed directly by means of an electric motor via a gear system and a lever, with end circuit breakers limiting movement in both directions. Other drive means, e.g. electric, electromechanical or pneumatic, are naturally also conceivable for opening and closing the flap 4. The stowage space 3 may also have a sliding roof, a folding roof or a rigid roller-blind, each of which can be electrically, electromechanically or pneumatically opened and closed.

In the stowage space 3 there is a scissors structure 7,17 which is driven via a spindle 6 by an electric motor 8. A toothed belt 19, for example, can be used to drive a wheel in the middle of spindle 6, as shown here. The bottom scissor ends are hinged to two cross-struts 18, which in turn are always guided parallel to each other along two fixed guide rods 20. The spindle 6 is guided in threads as it traverses the two cross-struts 18. If the spindle 6 is rotated, the two cross-struts 18 are either moved away from or towards each other along the guide rods 20. Depending on the movement, the scissors structure 7,17 extends upwards or is retracted and moves downwards until it is completely folded down. The two end positions are limited by end circuit breakers.

When the advertising support 11 is inflated and erect as shown here in FIG. 1, the scissors structure 7,17 is extended. The two scissors 7 advantageously consist of a number of hingedly connected tubes or profiles with rounded edges. The two scissors themselves 7 are connected with struts 17 with the points where the scissor elements are linked together being linked to these struts 17 at a lateral distance from each other so that when folded down, any sheet material of the advertising support 11 that accidentally ends up inbetween is not cut. Together with the struts 17, the scissors 7 form a stable-sided frame in the shape of a parallelogram. This parallelogram remains rigid at any height and ensures that the advertising support 11 can never tilt over and, in particular, that when retracted, it is folded down onto its base area inside the box 3 without tipping sideways, which would prevent the flap 4 from closing automatically. Once the advertising support 11 is deflated, the scissors structure 7,17 is retracted so that the individual scissor elements virtually lie on top of each other and the height of the scissors structure 7,17 is very low and can hence be accommodated in the stowage space 3, with the advertising support 11 being folded down around this scissors structure 7,17. Depending on the type of vehicle, a 12 or 24 volt fan, namely a radial or an axial fan 9, is also built into the stowage space 3 as shown here.

Above the spindle 6 and the fan 9 in the stowage space 3 there is an intermediate floor 10 with, in this case, a circular opening that is slightly smaller than the bottom opening of the advertising support 11, which in this case is a can of drink. Hence the bottom edge of the advertising support 11 stands on the intermediate floor 10. Arranged around the edge of the opening, which is circular here, and perpendicular to the intermediate floor is a ring a few centimeters high, over which the advertising support 11 is fitted. It is then held around the periphery of this ring with a steel band and a tensioning element. This allows the actual advertising support itself to be easily changed.

To erect and inflate the advertising support the flap 4 of the stowage space 3 is first opened automatically. The scissors structure 7,17 is then extended by an electric motor so that it pulls the advertising support 11 up with it, and air is simultaneously blown into the advertising support 11 by means of the fan 9 until it is fully inflated upwards and the scissors structure 7,17 stands freely inside. Conversely, when the advertising support 11 is retracted, air is sucked out by reverse operation of the fan 9 and the scissors structure 7,17 is folded together again by the electric motor, so that the advertising support 11 is substantially lowered down onto its original base area and folded down onto it. When the scissors structure 7,17 is completely retracted and as much air as possible has been sucked out by the ventilator 9, the flap 4 is closed by a motor. An ultrasonic sensor can be mounted on the cabin roof, on the spoiler 1 or on top of flap 4, with which the space above the spoiler 1 can be controlled. Such an ultrasonic sensor can detect any obstacles that may be present, as is the case if the lorry is parked e.g. under a tree or a projecting roof. This result is then signalled visually or acoustically in the driver's cabin, or the information is processed actively in a corresponding electric circuit. The entire advertising support can preferably be actuated automatically from the drivers seat. All that need be done to extend i.e. inflate the advertising support 11 is to press a button, whereupon e.g. a stored-program control unit (SPC unit) initiates the following steps: the first action is to check whether any obstacle is present in the space above the stowage space 3, and whether the vehicle is in motion, or whether the engine is running. When the ultrasonic sensor establishes that there is no obstacle present and ascertains that the engine is not running, e.g. via the engine revolutions counter, the electric control unit initiates the next step, namely the opening of the stowage space 3. In the example shown, a small winch unwinds a pull cord so that the gas-operated supports 5 extend and the flap 4 swings up. As soon as this operation is finished, the electric motor 8 is actuated and rotates the spindle 6 via the toothed belt 19, whereupon the scissors structure 7,17 extends upwards pulling the advertising support 11 upwards with it. Full extension of the scissors structure 7,17 actuates corresponding end circuit breakers and the electric control unit then recognizes that the advertising support 11 is fully inflated. The fan 9 can be switched on to inflate the advertising support 11 before, during or after the erection of the scissors structure 7,17. The advertising support attains its maximum size and is completely filled with air. The inflation procedure can also be accomplished by a source of compressed air, for which a special 12 or 24 volt compressor is required on the vehicle, with a pressure vessel of sufficient volume. This compressor and this vessel can also be integrated in the stowage space 3 or built onto the vehicle elsewhere.

If need be, the fan 9 or the source of compressed air can then be switched to a lower setting which is just sufficient to keep the advertising support stable and full. Only a slight excess pressure is required for this purpose. The inflation of the advertising support 11 should be configured so that the whole procedure takes from approx. 10 seconds to about 2 minutes maximum. If very rapid inflation is desired, use of compressed air is recommended, which can accomplish the inflation procedure in just a few seconds. It is worthwhile inflating the advertising support 11 whenever the lorry is loaded or unloaded, or when the driver takes a break and the vehicle is parked in a parking area or on private ground. It is advantageous if the advertising support 11 can be retracted in less time, e.g. in a few seconds, so that the lorry can be driven away quickly if need be. To enable rapid retraction, an opening can be contrived in the side of stowage space 3, below the intermediate wall 10, which can be closed by a sliding element which can be electrically actuated. When the advertising support 11 is retracted, it is passively deflated through this opening. A separate fan can also be used to accelerate deflation, or fan 9 for the inflating procedure can be run in reverse, as already mentioned. The retraction of the scissors structure 7,17 is controlled by the SPC unit and coordinated with the extraction of the air from the advertising support 11 so that the latter is folded down neatly and does not tilt over to the side. Complete retraction of the scissors structure 7,17 a gain actuates an end circuit breaker and after an interval which can be programmed into the SPC unit, during which the advertising support is completely folded down and deflated, the pull cord pulls the flap 4 against the force of the gas-operated sup ports 5, so that it again rests watertight on the spoiler 1. The fan power and speed of the spindle rotations should be adjusted relative to each other for each advertising support 11 so that one does not operate too quickly in comparison with the other.

In another variant, the advertising support can also be completely integrated in a lorry cabin superstructure. Such superstructures are supplied as sleeper superstructures and can be retrofitted on a lorry cabin. Such a superstructure can accommodate all the necessary elements such as the inflatable advertising support 11 itself, the scissors structure 7,17 and the fan 9 or the compressor unit. Alternative solutions in the form of, e.g. a sliding roof, a folding roof or a rigid roller-blind can be used instead of a flap 4 in the top. It is naturally important to ensure that this closable opening in the top is watertight when closed, and can also withstand the weight of snow.

Figure 2:
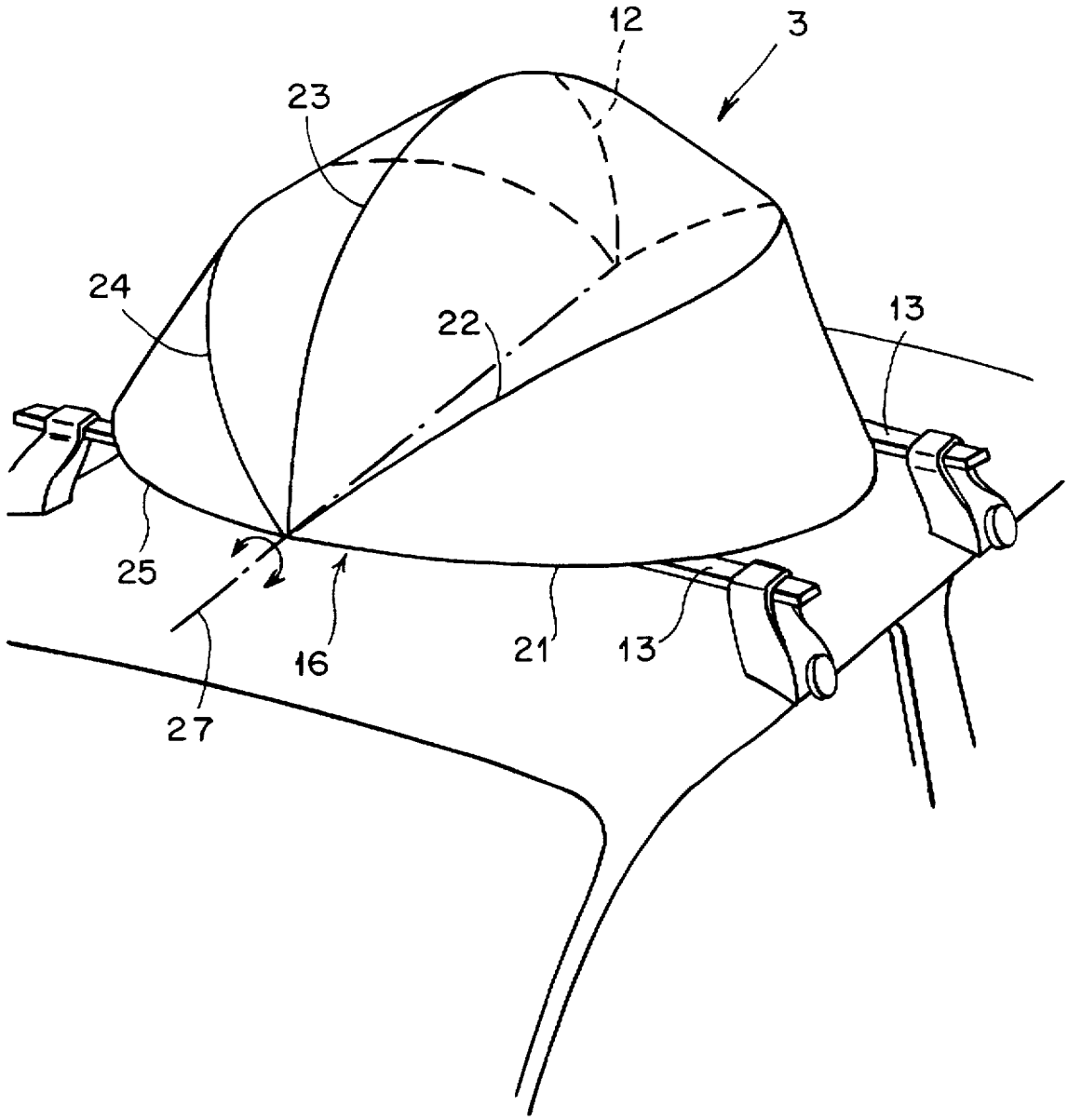
FIG. 2 shows an advertising support with inflatable support, with a dome-shaped stowage space, built onto a roof-rack for a vehicle roof, in an unused state.

One particular embodiment of the advertising support can be built onto a conventional roof-rack 13 and is shown in FIG. 2. The necessary roof-racks 13 are available from specialist retailers for almost every type of vehicle, whether car, delivery van or lorry. In this embodiment of the advertising support, the stowage space 3 with opening top consists of a dome-shaped tent construction 12. The latter has five or more semicircular-shaped struts 21–25, of which four (21–24) can be pivoted around a common axis 15. A concave sun blind, for example, as seen e.g. over the doors of shops, is suitable for such a construction, except for the fact that this concave structure can be pivoted not just by 90°, but by 180°. A thin, watertight film material can be used to cover the structure. The entire tent or concave structure is assembled on a circular base plate 16 which in turn can be screwed onto the roof-rack 13. The pivot axis 27 of the struts 21–24 then runs in the vehicle's longitudinal direction. This ensures that the dome 12 remains stable even at high travel speeds.

Figure 3:
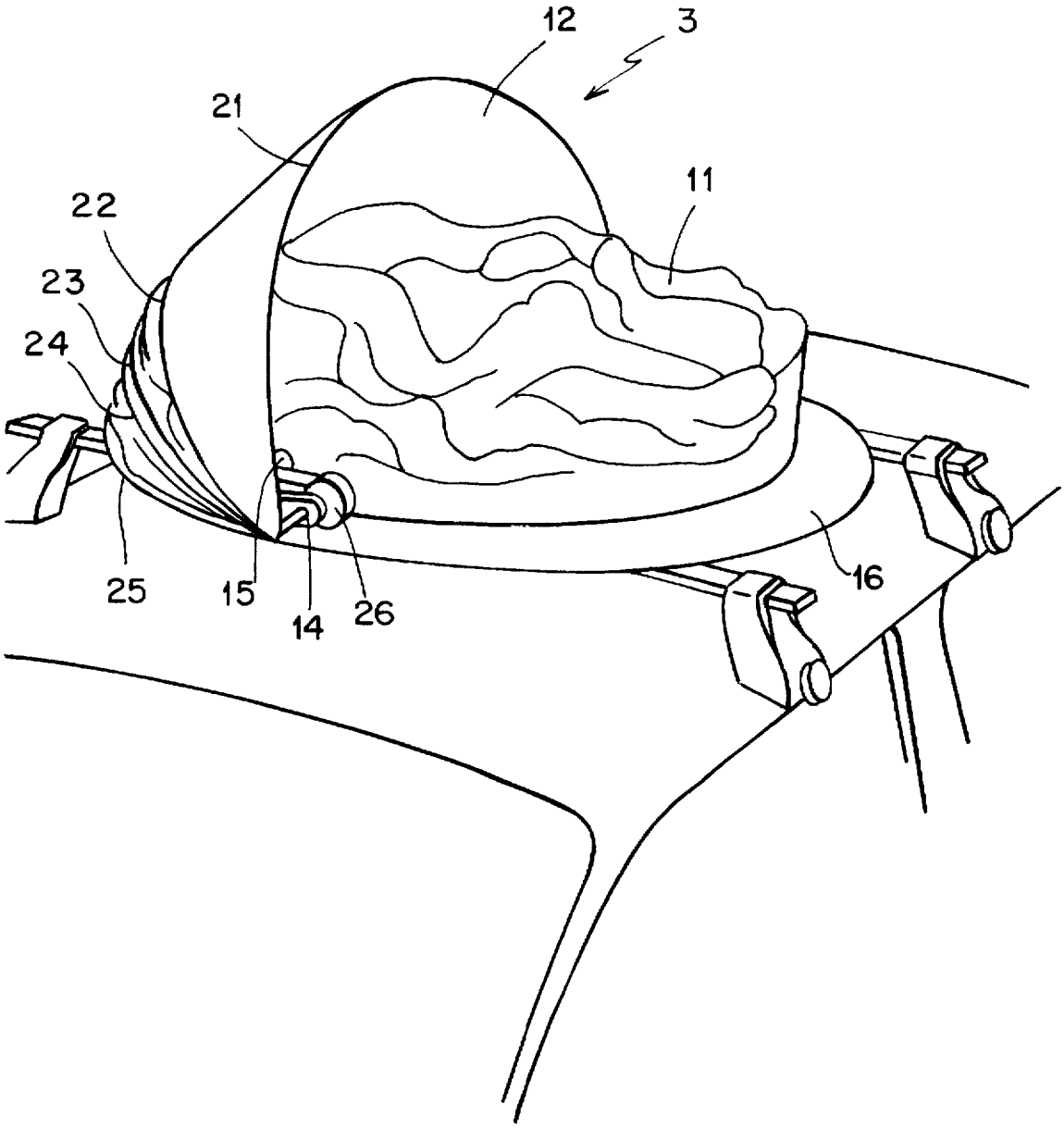
FIG. 3 shows the advertising support of FIG. 2 with the dome-shaped stowage space in a half-opened state.

FIG. 3 shows the dome 12 at the moment it is opened. The opening procedure is accomplished by a motor. For this purpose, only the outermost movable strut 21 is swung open and shut by an electric motor 15 via a reduction gear 26 and a lever 14. The other semicircular struts 22–24 are each borne along by the movement and strut 25 always remains stationary. In both end positions of the lever 14, the latter actuates an end circuit breaker. Lever 14 thereby exerts torque on strut 21, and closes or opens dome 12, depending on the direction of motion, until such motion is stopped by actuation of the end circuit breaker. After the dome 12 is swung open, the scissors structure is extended inside the advertising support 11 and the advertising support 11 itself is erected. 12 or 24 volt fans are used for this purpose, which can be disposed in a box on or under base plate 16, which, in this case, must have holes or a perforation. A spindle driven by an electric motor is started before, during or after inflation, which erects a scissors structure upwards in the manner already described.

Figure 4:
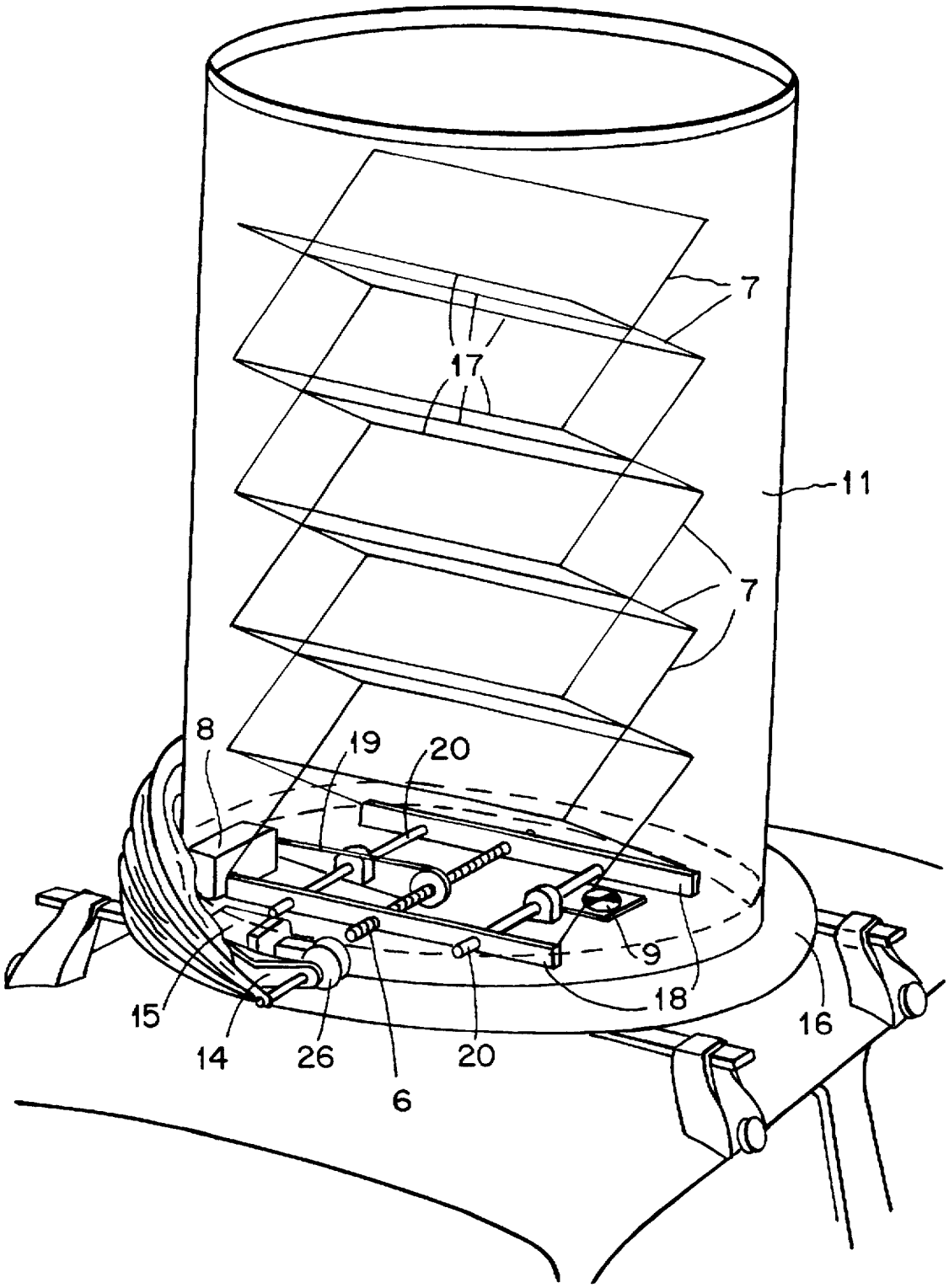
FIG. 4 shows the advertising support of FIG. 2 with the dome-shaped stowage space fully open, with inflated advertising support.

FIG. 4 shows this advertising support 11 in its inflated state. The extended scissors structure 7,17 is shown here inside the former. This scissors structure 7,17 ensures that the advertising support 11 cannot bend over or tilt over to the side in an uncontrolled manner when subsequently retracted or lowered, but folds together like bellows, so that it finally ends up folded down onto more or less its original base area, as shown FIG. 3. At the bottom, the ends of the two scissors 7 are hinged to two cross-struts 18 which are in turn guided parallel to each other by two guide rods 20 running crosswise to them. A spindle 6 traverses the two cross-struts 18 and this spindle 6 is driven by a motor 8 via a toothed belt 19. When the spindle 6 rotates, the two cross-struts 18 are moved towards or away from each other, whereupon the scissors 7 open and the scissors structure 7,17 is extended upwards, or the reverse, i.e. the scissors 7 close and the structure 7,17 is retracted downwards.

The advantages of this advertising support are obvious. The inflation and retraction procedures attract attention. The product being advertised is shown exactly as it normally appears, except that it is very enlarged and hence stays in the spectator's memory to particularly good effect. Vehicles fitted with such advertising supports can be used as a highly effective publicity platform in parking areas, handling areas, in inner city areas, e.g. when loading or unloading in a pedestrian zone, or simply when the vehicle is in normal use. Built onto a car, the advertising support can be inflated at any type of event where there are large numbers of people, e.g. at outdoor events such as pop concerts, sports meetings, markets, fairs and exhibitions etc. etc. Another advantage is that the inflated advertising support extends upwards by several meters above the height of a lorry or delivery van cabin, or the height of a car roof, and hence is visible from far around. At this height it is also safe from vandals.

It would also be conceivable to build such an advertising support onto a car or lorry trailer which could then be used in a targeted manner purely as a publicity platform. The advantage here is that the advertising support can be very quickly transported to the site and inflated there, which would not tie up an entire lorry or car, but just a trailer, which would remain at the site as a vehicle for the advertising support.

The advertising supports used can be in any manner of forms. For example, enlarged shoes, bottled cleaning products, computers, televisions, washing-machines, tins of creams, packets of washing-powder etc. etc. are conceivable. The possibilities are virtually endless. The only condition is that the inflated advertising support is provided with the stability it needs to stand upright. If the advertising support is in a branched form, e.g. in the shape of a human being with arms and a head, then several cords can be connected on the inside to each extremity, i.e. to the end of the branches so that the retraction process can be accomplished without any problems. The cords are then retracted in the right order, for which purpose they are attached directly or via a reversed block and tackle to the struts 17 of the scissors structure 7,17, so that they can be retracted faster than the scissor structure 7,17 itself. A special type of effect is achieved if an electric ring circuit is realised to ensure that the advertising support is continuously inflated, left in this state for a few moments and then retracted again, whereupon the spectacle repeats itself endlessly. Finally, the advertising support can be fitted with lighting means allowing the inflated advertising support to be illuminated from outside or inside.

I claim:

1. An advertising support for fitting on a vehicle, comprising:

an inflatable advertising support a dome-shaped tent construction made of at least five semicircular-shaped struts, of which four of said semicircular struts are pivotable around a common axis, covered by a thin, watertight, weatherproof sheet material, said dome-shaped tent construction being assembled on a circular base plate having a fan with said circular base plate being attachable onto a roof-rack, with said fan acting as means for automatic inflation of said inflatable advertising support, said dome-shaped tent construction serving as a stowage space for said inflatable advertising support stowed inside said dome-shaped tent construction wherein, when said semicircular struts which are pivotable are pivoted to one side, thereby opening said stowage space, said inflatable advertising support being able to be automatically inflated upwards by said means for automatic inflation and retracted downwards therefrom by said means for automatic inflation.

2. The advertising support according to claim 1, further comprising a scissors structure able to be moved between a retracted position and an expanded position, said scissors structure being mounted on said circular base plate inside said inflatable advertising support and which is erectable by a motor and which forms a free standing, stable-sided parallelogram and, in the expanded position, extends vertically within said inflatable advertising support for ensuring that, when said scissors structure is in the retracted position and said inflatable advertising support is deflated, said inflatable advertising support is substantially folded down onto its original base area and prevented from tipping sideways by a lateral stability provided by said scissors structure.

* * * * *